US008336608B2

(12) United States Patent
Zhang et al.

(10) Patent No.: US 8,336,608 B2
(45) Date of Patent: Dec. 25, 2012

(54) VAPOR CHAMBER AND METHOD FOR MANUFACTURING THE SAME

(75) Inventors: Sheng-Chao Zhang, Shenzhen (CN); Zhi-Yong Zhou, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 522 days.

(21) Appl. No.: 12/581,172

(22) Filed: Oct. 19, 2009

(65) Prior Publication Data

US 2011/0030921 A1 Feb. 10, 2011

(30) Foreign Application Priority Data

Aug. 5, 2009 (CN) ..... 2009 1 0305255

(51) Int. Cl.
*F28D 15/00* (2006.01)
*E04C 5/16* (2006.01)

(52) U.S. Cl. ..... 165/104.26; 52/719; 52/664

(58) Field of Classification Search ..... 165/104.26; 428/608, 594, 68, 76, 131; 52/719, 664, 52/684–686, 388
See application file for complete search history.

(56) References Cited

U.S. PATENT DOCUMENTS

| | | | | |
|---|---|---|---|---|
| 1,281,856 | A * | 10/1918 | Shaw | 446/112 |
| 4,493,425 | A * | 1/1985 | Yoshida | 211/189 |
| 5,027,959 | A * | 7/1991 | Luukkonen | 211/186 |
| 6,827,134 | B1 * | 12/2004 | Rightley et al. | 165/104.26 |
| 7,013,958 | B2 * | 3/2006 | Garner et al. | 165/104.26 |
| 7,159,647 | B2 * | 1/2007 | Hsu | 165/104.26 |
| 7,770,630 | B2 * | 8/2010 | Chesser et al. | 165/65 |
| 2005/0098303 | A1 * | 5/2005 | Lindemuth et al. | 165/104.26 |
| 2008/0040925 | A1 * | 2/2008 | Lee et al. | 29/890.03 |
| 2008/0115448 | A1 * | 5/2008 | Kodi | 52/719 |
| 2009/0025910 | A1 * | 1/2009 | Hoffman et al. | 165/104.26 |
| 2009/0205812 | A1 * | 8/2009 | Meyer et al. | 165/104.26 |
| 2010/0006268 | A1 * | 1/2010 | Meyer et al. | 165/104.26 |
| 2010/0294200 | A1 * | 11/2010 | Zhang et al. | 118/728 |
| 2011/0005725 | A1 * | 1/2011 | Hou et al. | 165/104.26 |

FOREIGN PATENT DOCUMENTS

GB 2173447 A * 10/1986

* cited by examiner

*Primary Examiner* — Frantz Jules
*Assistant Examiner* — David S Einfeldt
(74) *Attorney, Agent, or Firm* — Altis Law Group, Inc.

(57) ABSTRACT

A vapor chamber includes a sealed flattened casing containing working liquid therein, a wick structure arranged on an inner face of the casing, a plurality of supporting posts received in the casing and at least a metallic wire connecting the supporting posts. Each supporting post defines at least a channel therein. The at least a metallic wire engagingly extends through the channels of the supporting posts. Top and bottom ends of the supporting posts engage the wick structure to reinforce a structure of the vapor chamber.

8 Claims, 6 Drawing Sheets

VAPOR CHAMBER AND METHOD FOR MANUFACTURING THE SAME

BACKGROUND

1. Technical Field

The disclosure relates to a vapor chamber and, more particularly, to a vapor chamber having a firm structure.

2. Description of Related Art

Nowadays, numerous vapor chambers are used to dissipate and transfer heat generated by electronic devices. Generally, the vapor chamber includes a plate-shape casing having a lower plate thermally contacting the electronic device. A vacuum chamber is defined in the casing. A wick structure is formed on an inner face of the casing, and a working fluid is contained in the chamber. As the electronic device is maintained in thermal contact with the lower plate of the casing, the working fluid contained in the chamber corresponding to a hotter location vaporizes into vapor. The vapor then spreads to fill the chamber, and wherever the vapor comes into contact with a cooler location of the chamber, it releases its latent heat and condenses to liquid. The liquid returns to the hotter location via a capillary force generated by the wick structure. Thereafter, the working fluid frequently vaporizes and condenses to form a circulation to thereby remove the heat generated by the electronic device.

However, the plate-shape casing of the vapor chamber is prone to deforming when subjected to an inner or outer pressure during use, which further results in the wick structure disengagement from the inner face of the casing, adversely affecting the reliability and performance of the vapor chamber.

What is needed, therefore, is a vapor chamber which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
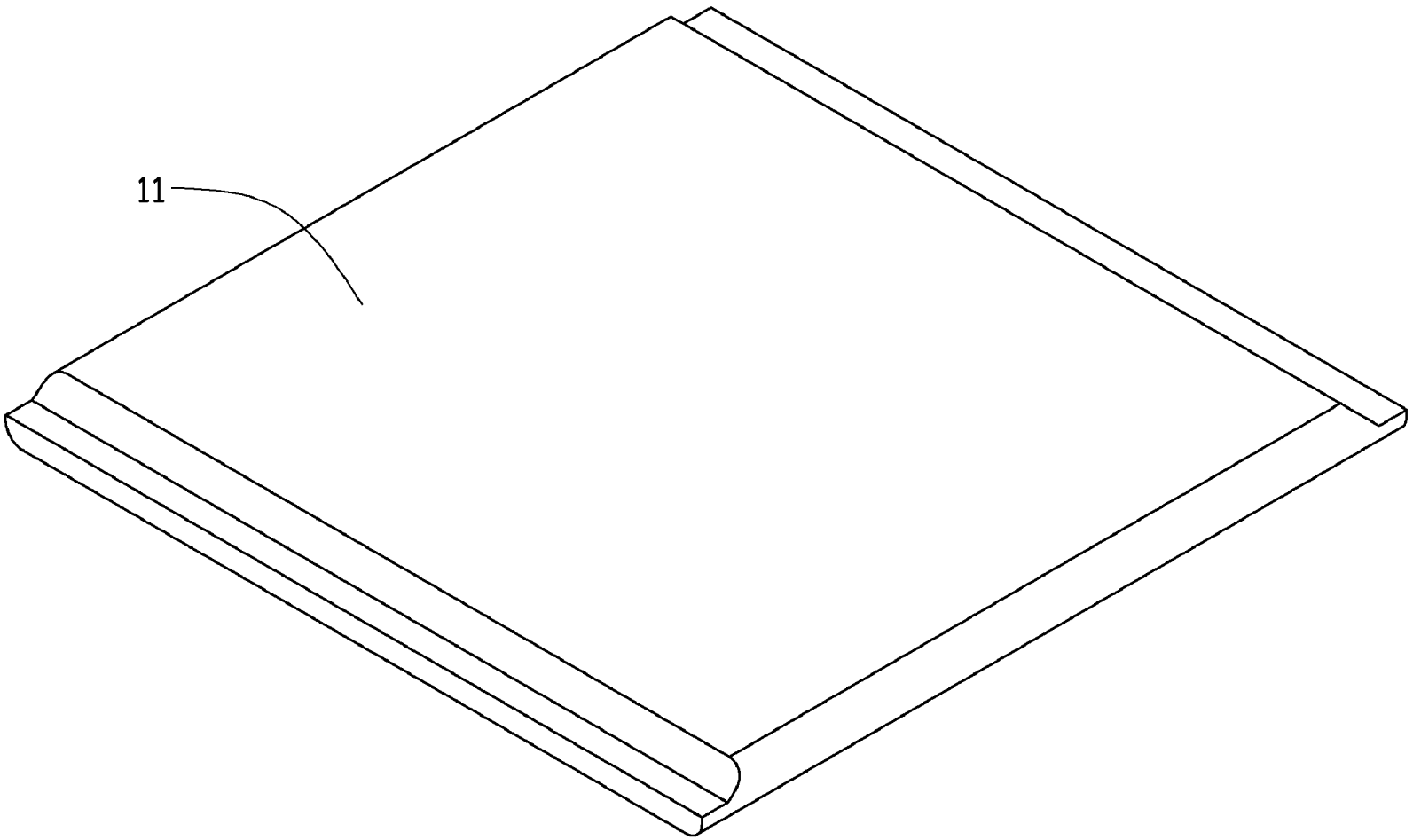
FIG. 1 is an isometric, assembled view of a vapor chamber in accordance with a first embodiment of the present disclosure.

As shown in FIGS. 1-5, a vapor chamber in accordance with a first embodiment of the disclosure includes a casing 11, a wick structure 13 formed on an inner face of the casing 11 and a supporting structure received in the casing 11 and engaging the wick structure 13. Working liquid (not shown) is filled in the casing 11.

The supporting structure is reticulate and includes a plurality of supporting posts 30 and a plurality of metallic wires 20 interconnecting the supporting posts 30. The supporting posts 30 are arranged in a matrix and formed by molding and sintering metal powder. Each supporting post 30 is a cylinder with a circular section and defines two perpendicular channels 32 in two opposite ends thereof. Top and bottom faces of the supporting posts 30 are located at the same planes and contact top and bottom of the inner face of the wick structure 13.

The metallic wires 20 each have a length smaller than a length and a width of the casing 11. A diameter of each metallic wire 20 is slightly larger than a width of the channel 32 of the supporting post 30, whereby the metallic wire 20 can be interferingly fitted in the channel 32 of the supporting post 30. The metallic wires 20 are respectively pressed into the channels 32 of the supporting posts 30 to form the supporting structure. The metallic wires 20 form a grid-like structure. Spaces in the grid of the supporting structure can act as vapor passages for vaporized working liquid flowing upwardly therethrough during working of the vapor chamber. Two metallic wires 20 connected with the same supporting post 32 are not in the same plane. All of the metallic wires 20 at the two opposite ends of the supporting posts 30 are distributed in two planes parallel to each other.

A method of manufacturing the vapor chamber includes the following steps.

Figure 2:
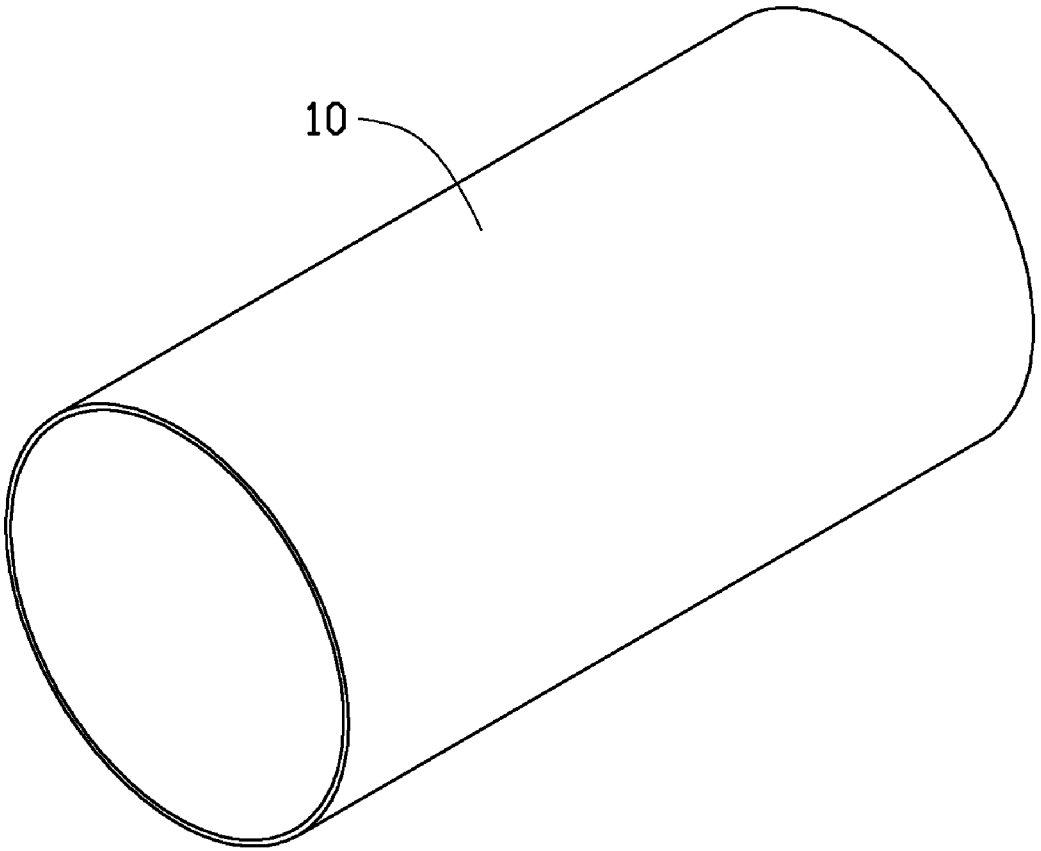
FIG. 2 is a schematic view of a metal tube for manufacturing a casing of the vapor chamber of FIG. 1.

Firstly, as particularly shown in FIG. 2, a metal tube 10 is provided. The metal tube with a predetermined length is made of a material with a good thermal conductivity such as copper.

Figure 3:
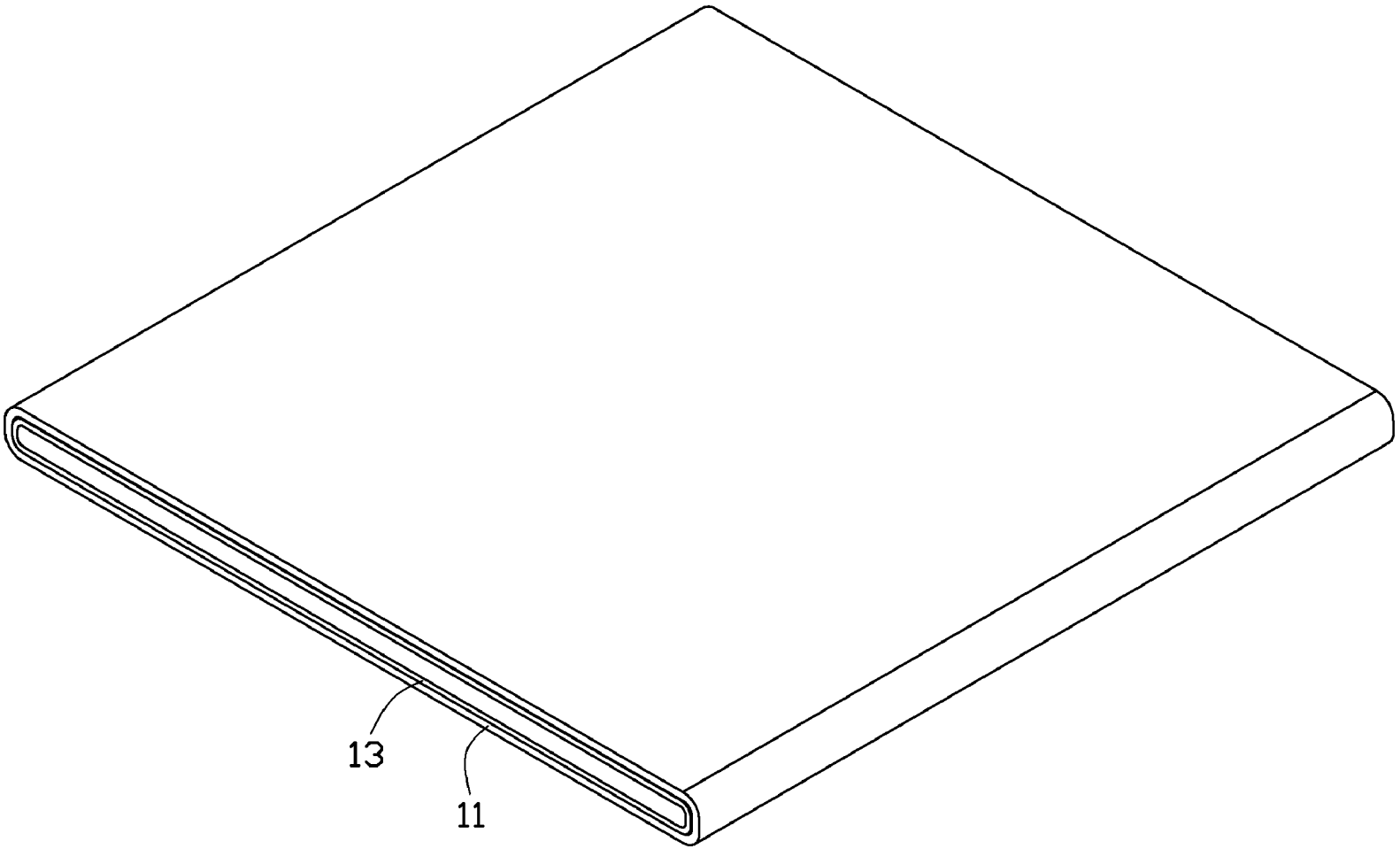
FIG. 3 is a schematic view of the metal tube of FIG. 2 being flattened into the casing with a wick structure arranged on an inner face thereof.

Secondly, as particularly shown in FIG. 3, the metal tube 10 is flattened into the rectangular plate-shape casing 11 and thus has two elongated openings at two opposite ends thereof.

Thirdly, an insert (not shown) is provided and inserted into the casing 11. The insert has a configuration similar to that of the casing 11, but is in a slightly smaller size than the casing 11. Metal powder is filled between the inner face of the casing and an outer surface of the insert and then is sintered on the inner face of the casing 11 to form the wick structure 13 over the inner face of the casing 11 by heating the metal powder. In this embodiment of the present disclosure, the insert is a solid block made of metal and drawn from the casing 11 after the powder is sintered on the inner face of the casing 11. In alternative embodiments of the present disclosure, the insert can be a hollow block formed by weaving meshes and simultaneously sintered on the inner face of the casing 11 to be a part of the wick structure 13.

Figure 4:
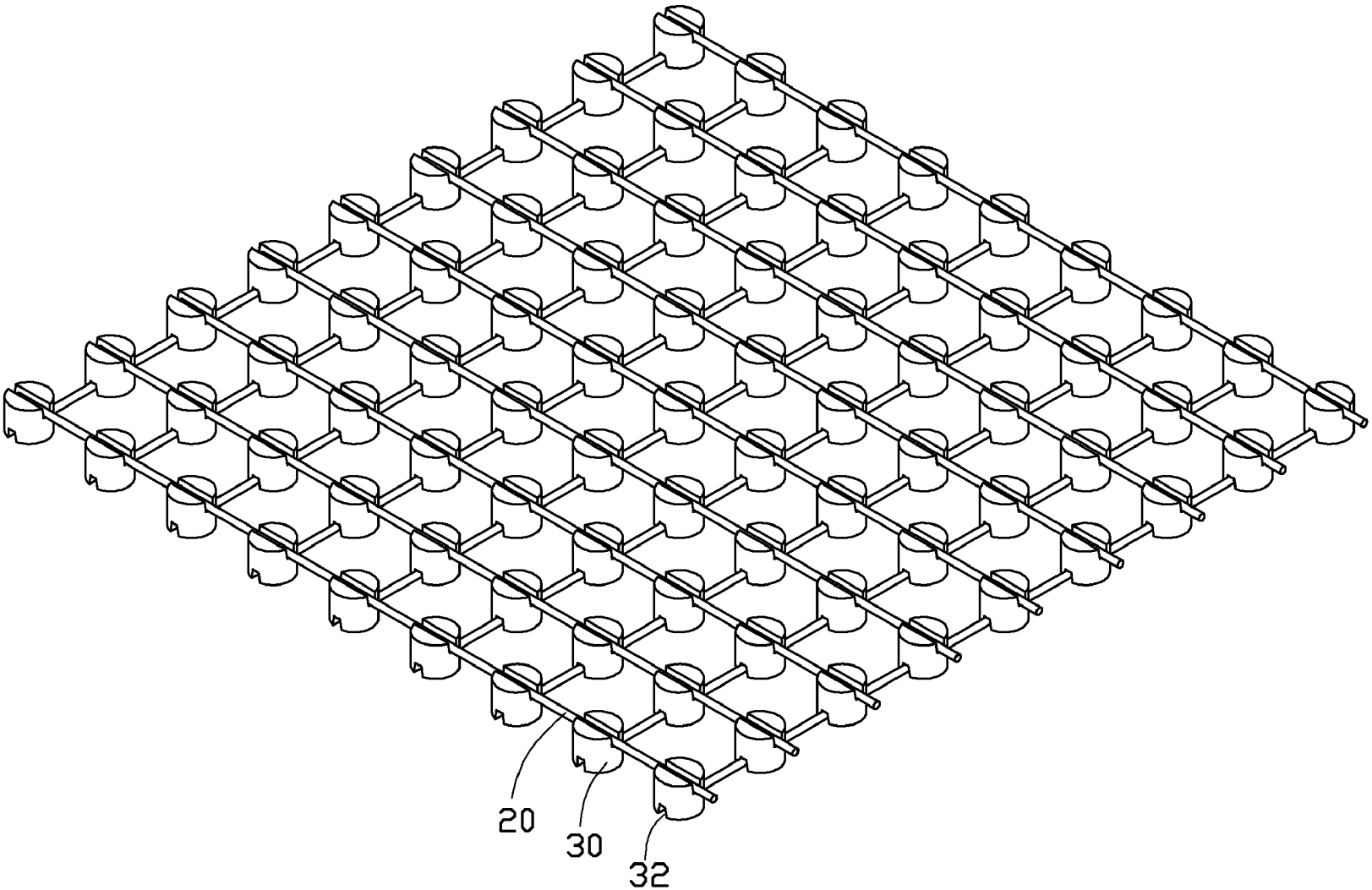
FIG. 4 is a schematic view of a supporting structure of the vapor chamber.
Figure 5:
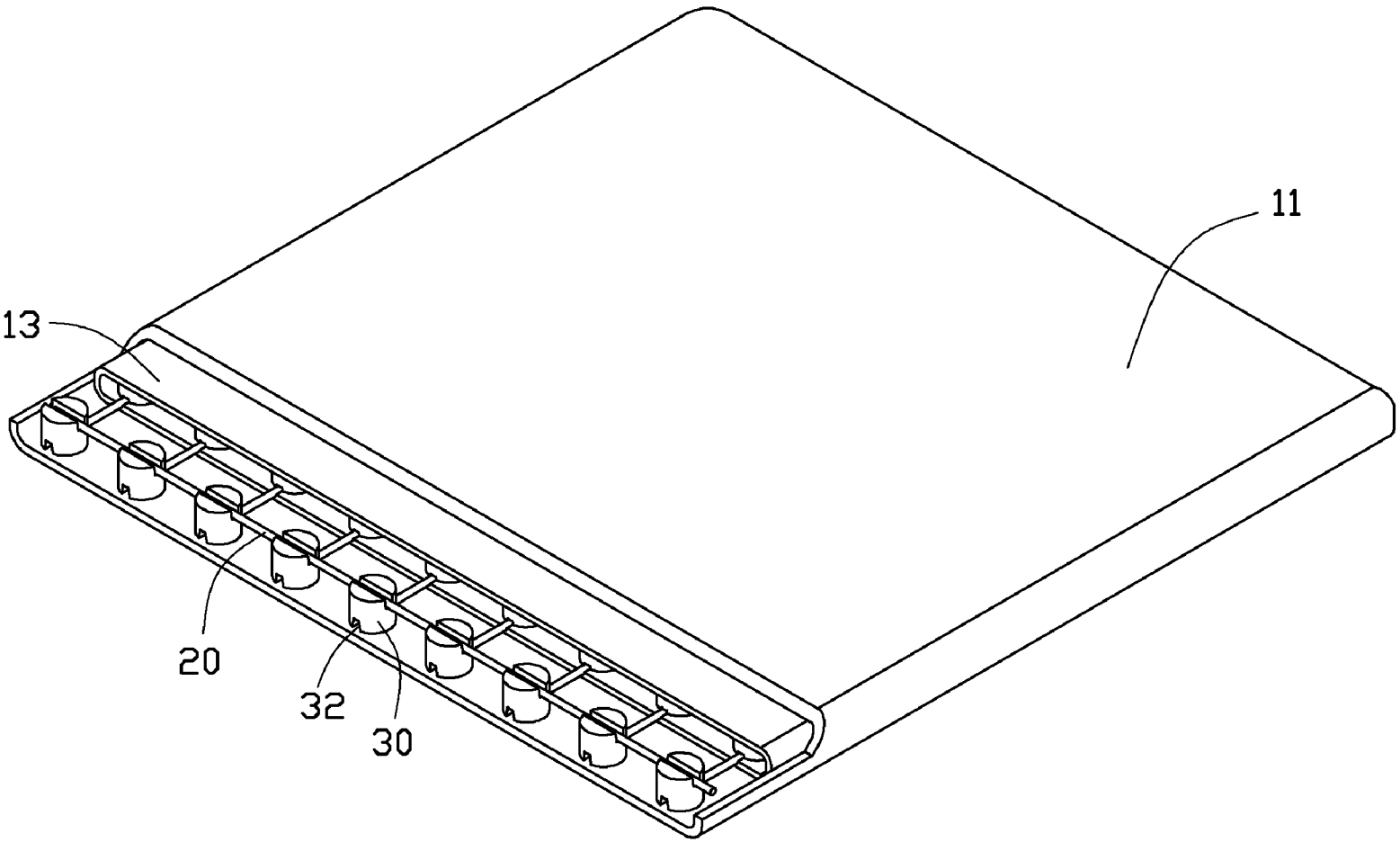
FIG. 5 is a schematic view of the casing of the vapor chamber of FIG. 3 receiving the supporting structure of FIG. 4 therein, in which a part of the casing is cut away for clarity.

Fourthly, as particularly shown in FIG. 4, the supporting posts 30 are provided. Each supporting post 30 defines two perpendicular channels 32 along top and bottom ends thereof. The channels 32 in the bottom ends of the supporting posts 30 which are located at the same line are aligned with each other, and the channels 32 in the bottom ends of the supporting posts 30 which are located at different lines are parallel to each other. Similarly, the channels 32 in the top ends of the supporting posts 30 which are located at the same row are aligned with each other.

Fifthly, the metallic wires 20 are provided. The metallic wires 20 are respectively pressed into the channels 32 of the supporting posts 30, whereby a combination of the supporting posts 30 and the metallic wires 20 is obtained to form the supporting structure of the vapor chamber. The supporting structure prevents the casing 11 from deforming due to unexpected outer or inner pressures. The supporting structure has a regular rectangular, grid-shape with the metallic wires 20 perpendicular to each other and each of the supporting posts 30 located at a conjunction of two intersecting metallic wires 20.

In the following step, the assembly of the supporting posts 30 and the metallic wires 20 is placed into the casing 11. The casing 11 is then vertically compressed by exerting a compressing force on two opposite top and bottom flat surfaces thereof to make the top and bottom surfaces of the supporting posts 30 tightly engage the top and bottom of the wick structure 13 arranged on the inner face of the casing 11.

Finally, the two opposite open ends of the casing 11 are sealed by pressing and welding. A small port is defined in one of the two sealed opposite ends. The casing 11 is then filled with working liquid and vacuumed via the port. Finally, the port is sealed by pressing and welding to thus complete a manufacturing of the vapor chamber incorporating the supporting structure therein.

Figure 6:
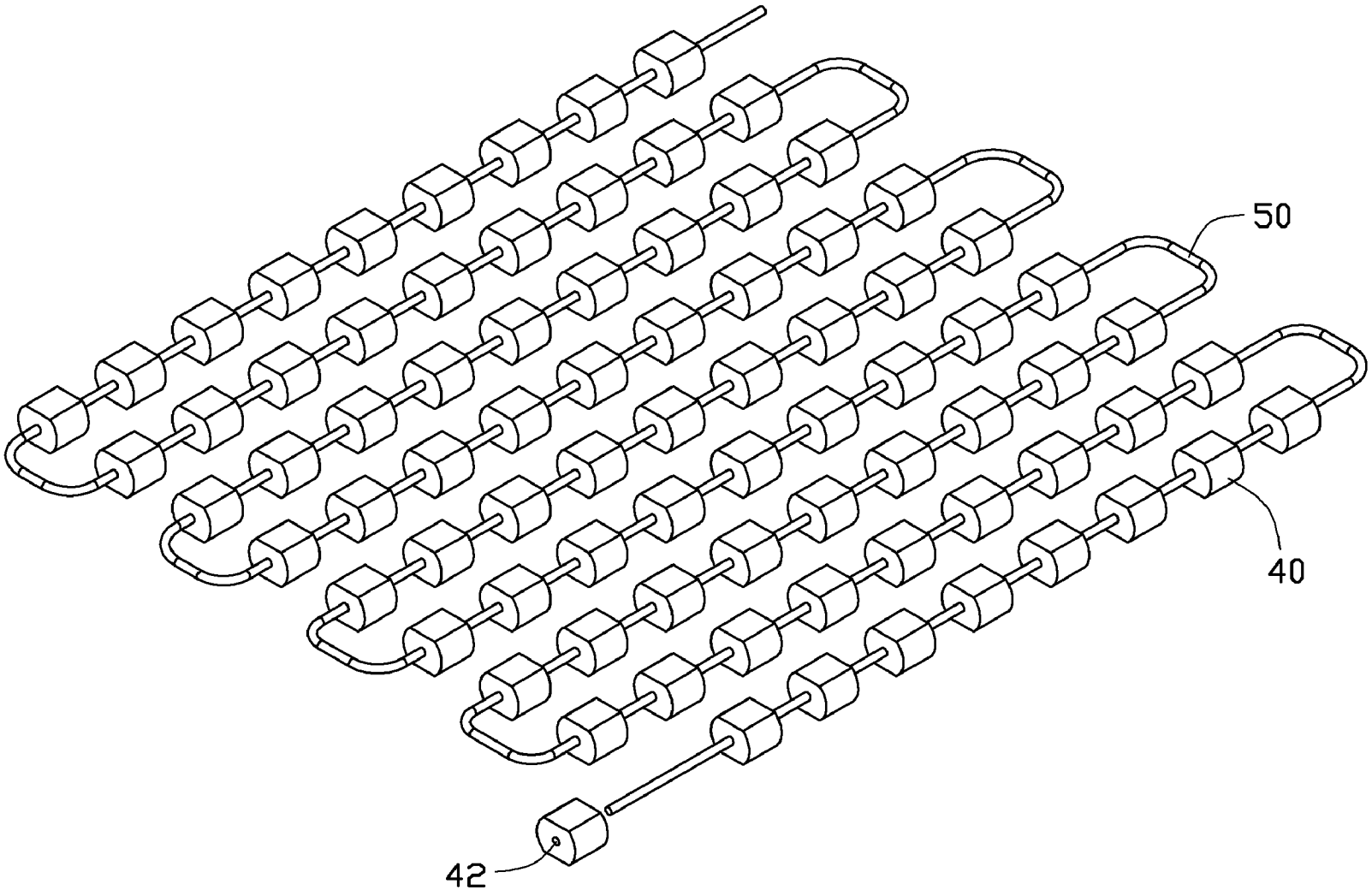
FIG. 6 is a schematic view of a supporting structure of a vapor chamber in accordance with a second embodiment of the disclosure.

A second embodiment of the disclosure is similar to the first embodiment, except the configuration of the supporting structure. As shown in FIG. 6, each supporting post 40 of the supporting structure of the second embodiment is horizontally oriented and defines a channel 42 through a center thereof. The post 40 has flat top, bottom, front and rear faces and arced left and right faces. The channel 42 extends horizontally through the front and rear faces of the post 40. A serpentine metallic wire 50 continuously extends through the channels 42 of the supporting posts 40 to make the supporting posts 40 arranged on the metallic wire 50. Two neighboring posts 40 are spaced from each other a constant distance along an extending direction of the wire 50. The supporting posts 40 attached on the metallic wire 50 are arranged in a matrix.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A vapor chamber comprising:

a sealed flattened casing containing working liquid therein;

a wick structure arranged on an inner face of the casing;

a plurality of supporting posts received in the casing and each post containing at least a channel, top and bottom faces of the supporting posts engaging the wick structure;

at least a metallic wire engagingly passing through the channels of the supporting posts to interconnect the supporting posts;

wherein the supporting posts are arranged in a matrix, each of the supporting posts defining two channels along two opposite ends thereof, a plurality of metallic wires being interferingly pressed in the channels of the supporting posts; and wherein the metallic wires pressed in the channels of the supporting posts are perpendicular to each other to form a grid-shape structure, spaces in the grid of the metallic wires acting as vapor passages for vaporized working liquid flowing therethrough during working of the vapor chamber.

2. The vapor chamber of claim 1, wherein the two channels of each of the supporting posts are perpendicular to each other.

3. The vapor chamber of claim 1, wherein the metallic wires fitted in the channels in the same ends of the supporting posts are parallel to each other.

4. The vapor chamber of claim 3, wherein two metallic wires connected with one of the supporting posts are located at different planes.

5. The vapor chamber of claim 3, wherein the metallic wires pressed in the channels in the two opposite ends of the supporting posts are distributed in two planes parallel to each other.

6. The vapor chamber of claim 1, wherein the supporting posts are formed by molding and sintering metal powder.

7. The vapor chamber of claim 1, wherein each supporting posts has a configuration of a cylinder.

8. The vapor chamber of claim 1, wherein the top faces of the supporting posts are located at a same plane, the bottom faces of the supporting posts are located at another same plane, and the supporting posts are sandwiched between two facing portions of the wick structure arranged on the inner face of the casing.

* * * * *